US005504718A

United States Patent [19]

Gaynor

[11] Patent Number: 5,504,718

[45] Date of Patent: Apr. 2, 1996

[54] BEAM CONVERGENCE MODULE

[75] Inventor: Richard E. Gaynor, Clermont, Fla.

[73] Assignee: Wadi, Inc., Clermont, Fla.

[21] Appl. No.: 323,792

[22] Filed: Oct. 17, 1994

[51] Int. Cl.[6] ..... H01Q 13/00

[52] U.S. Cl. ..... 367/138; 367/905; 342/104; 343/776

[58] Field of Search ..... 367/138, 150, 367/119, 103, 905; 181/0.5, 22, 196; 343/772, 776, 778; 342/104

[56] References Cited

U.S. PATENT DOCUMENTS 3,699,481 10/1972 Thompson et al. ..... 333/145

3,783,967 1/1974 Apgar ..... 367/151

5,341,346 8/1994 Youlton ..... 367/138

*Primary Examiner*—Daniel T. Pihulic

*Attorney, Agent, or Firm*—Macdonald J. Wiggins

[57] ABSTRACT

A module formed by an array of pipes is provided for installation in front of existing radar and sonar transducers. A preferred array is formed by a section of honeycomb material in which each pipe has a hexagonal cross section and is mounted in an insulating sheath. Each pipe acts as a radiator of energy from a transducer that combine in phase to produce a beam narrower than the beam from the transducer. The module is effective to improve the range and resolution of forward-looking radar and sonar devices.

12 Claims, 2 Drawing Sheets

BEAM CONVERGENCE MODULE

BACKGROUND OF THE INVENTION

1. Field of the Invention

The present invention relates to sonar and radar type devices, and more particularly to a module for attachment to the radiating element of such devices for converging the beam to a narrower and less divergent beam.

2. Description of the Prior Art

Forward-looking sonar and radar devices are widely used for detecting objects that are not visible to the user. For example, sonar devices are used in commercial, military, and pleasure craft to detect underwater objects. In particular, a number of endangered mammals must be located by power craft at sufficient distance to avoid such mammals. Radar devices used for traffic control in current use have difficulty in discriminating among several vehicles, reducing the effectiveness of the tool.

The beamwidths of radiation from current sonars are too wide to pinpoint a mammal in sufficient time to avoid injury or death to the mammal. Thus, means are needed to reduce the beam angle of such sonars. For example, a typical 200 kHz unit utilizing a transducer having a diameter of about 2.325", produces an 8 degree beam. Applying prior art to reduce the beam angle to 1 degree would require a transducer having a diameter of about 17 inches. Such a large transducer is expensive, and it is difficult to obtain hydrodynamic stability in water with such a large device.

Doppler radar devices typically have broad beams of 12 to 40 degrees. Rust, in U.S. Pat. No. 2,785,397, teaches an external annular lens for reducing the beam angle. However, such a lens is too bulky for a hand held instrument commonly used for traffic control. Beam blocking and slicing techniques are taught by Pickering in U.S. Pat. No. 3,528,072. The size, weight and power loss of this approach makes it impractical. Other related U.S. patents include: U.S. Pat. No. 2,751,586 to Riblet; U.S. Pat. No. 2,801,412 to Mayburg; U.S. Pat. No. 2,840,811 to McMillan; and U.S. Pat. No. 5,113,197 to Luh. Schaufelberger, U.S. Pat. No. 3,833,909 teaches a rapidly scanning, wide angle, directional antenna system having a scanning horn, an inversion element, and coupled to a Luneberg lens type collimating device. Wolff, U.S. Pat. No. 2,206,683 includes a sectionalized horn fed by an adjustable attenuator.

Thus, an apparatus and method for reducing the beam angle of existing sonar and Doppler radar devices, using an add-on beam convergence device that does not significantly increase the physical size or cost of the device, is not taught by the known prior art.

SUMMARY OF THE INVENTION

The beam convergence module of the invention utilizes an array of bundled parallel pipes in which the bundle has a cross sectional area essentially matching the area of the transducer of an existing sonar or radar device. Preferably, each pipe has a hexagonal cross section formed from a metal material and of a length selected in accordance with the transducer frequency. Preferred material is a honeycomb formed of thin metal. The bundle of pipes is suitably mounted in front of the radar or sonar transducer.

The basic theory of the convergence module may be understood from the well-known radio antenna array equations. A beam produced by 2n+1 radiating elements separated by ½ wavelength, with each element radiating the same in-phase signal, will converge with an angle determined by the number of elements. The number of elements required for a given beam width may be determined by solving for "n" from the above noted relationship: 1.77 Rad/(2n+1).

A typical example of an available device is a sonar transducer having a diameter of 1 inch that produces a beam of 20 degrees. Another sonar device has a transducer with a diameter of 2.325", and produces an 8 degree beam. Thus, in the prior art, a larger diameter transducer is required to produce a narrow beam. However, in accordance with the invention, closely coupling a beam convergence module to the above mentioned 8 degree beam transducer reduces the beam width to 0.70 degrees. The diameter of the module is 2.325", the same as the that of the 8 degree transducer, and utilizes about 144 hexagonal pipes formed from honeycomb material. A quarter wavelength coupler is disposed between the transducer and the module. The resulting beam produces a target spot of about 15 feet at a 1000 foot range. The resulting forward range is increased from 100 feet to 1000 feet.

In an X-band radar unit having a horn antenna and a beam width of 12 degrees, a bundle of insulated pipes mounted in the horn feed wave guide may converge the beam to 4 degrees or less, dependent on the number of pipes.

It is therefore a principal object of the invention to provide a beam convergence module for attachment to a sonar or radar device for significantly reducing the radiated beam width of the device and increasing the range of the device.

It is another object of the invention to reduce the beam width of a sonar or radar beam without significantly increasing the size of sonar or radar device.

It is still another object of the invention to increase the range of a sonar or a radar device.

It is yet another object of the invention to provide a beam convergence device for sonar and radar devices utilizing a bundle of pipes adjacent the outputs of the devices.

These and other objects and advantages of the invention will become apparent from the following detailed description when read in conjunction with the drawings.

DETAILED DESCRIPTION OF THE PREFERRED EMBODIMENT

Figure 1:
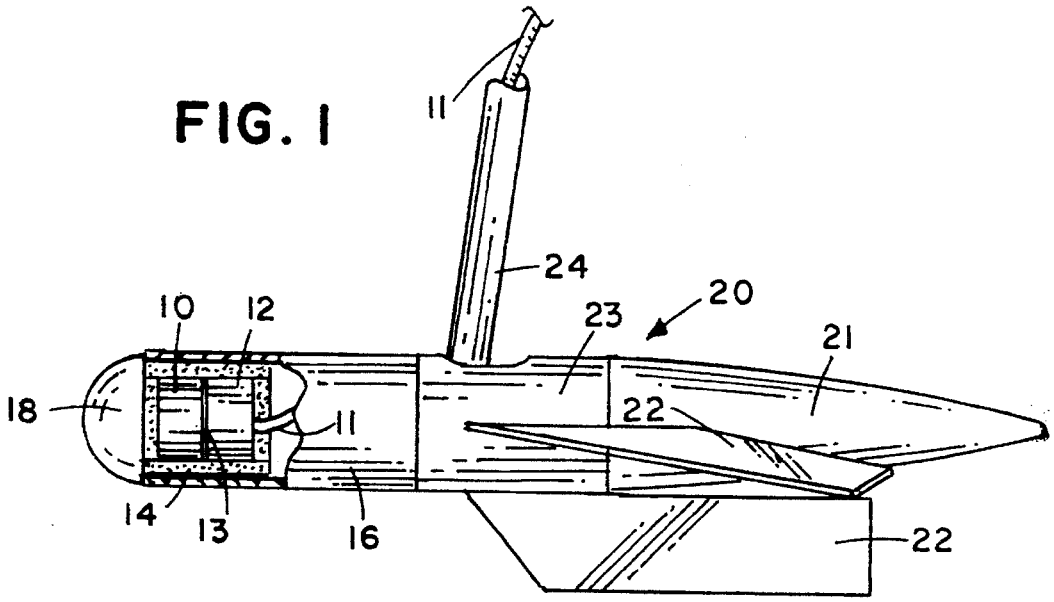
FIG. 1 is partially cutaway view of the transducer portion of a forward-looking sonar device, showing the transducer, and the beam convergence module of the invention.

Referring to FIG. 1, a partially cut away of the pod 20 of a forward looking sonar, for use in watercraft, is shown with a beam convergence module 10 of the invention added thereto. The basic sonar, operating in the 200 kHz range, utilizes a transducer 12 that produces an 8 degree beam. Transducer 12, having a diameter of 2.325 inches, is disposed in energy-containing tubular body section 16. Body section 16 may be metallic. A beam convergence module 10 having a diameter of 2.325 inches is disposed forward of transducer 12 with quarter-wave phasing section 13 therebetween. The length of module 10 affects the distance ahead of the transducer at which the beam begins to converge. In this implementation of the invention, a module length of 4.3 inches has been found to converge the normally 8 degree beam of transducer 12 to 1 degree fourteen feet ahead of the pod 20, and a forward range of 1,000 feet in 20 foot depth of water has been achieved.

Transducer 12 and module 10 are supported in body 16 by cylindrical, acoustic attenuating material 14. Transducer 12 is fed by cable 11 through tube 24 to an onboard control and display unit (not shown). A nose piece 18 of molded plastic, or other materials having low attenuation to the sonar frequency is attached to the forward end of pod 20. The pod 20 also includes body portion 23, tail piece 21 and hydrodynamic stabilizing fins 22 that stabilize the pod for up to 50 mph in water.

Figure 2:
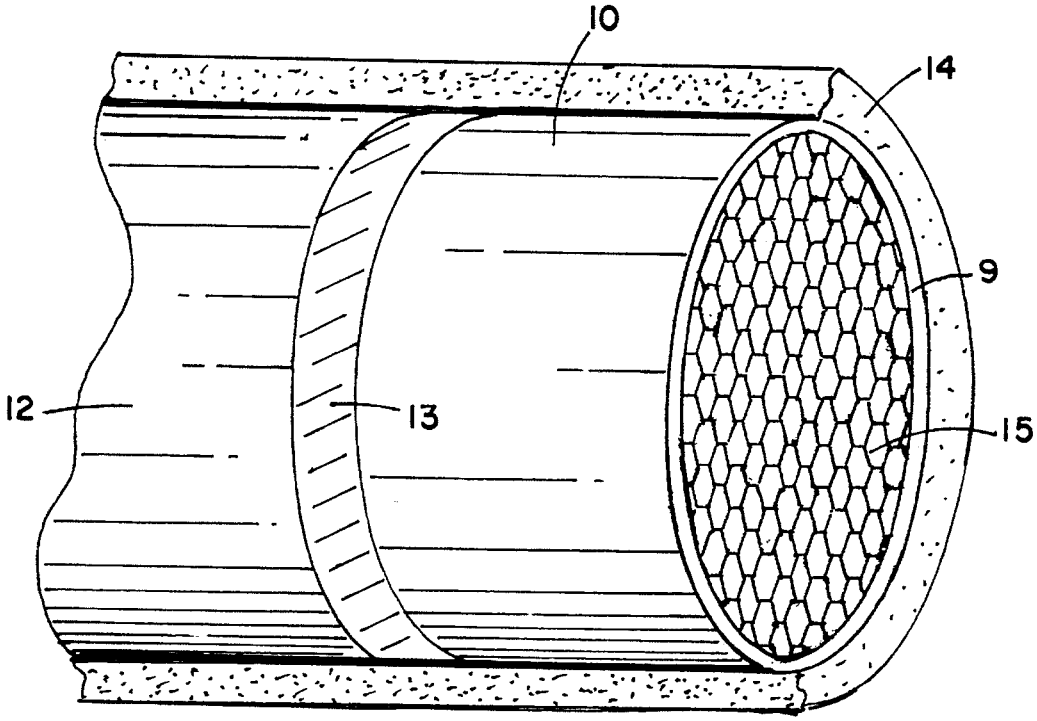
FIG. 2 is a perspective exploded view of the beam convergence module of FIG. 1 showing a bundle of hexagonal pipes disposed adjacent the sonar transducer.
Figure 3:
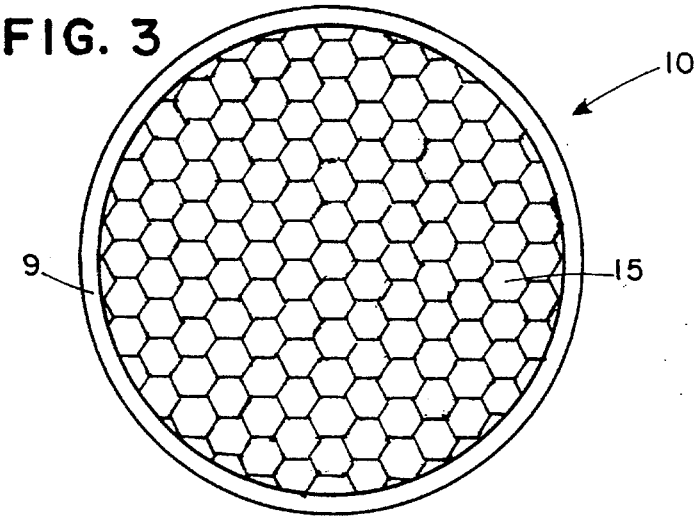
FIG. 3 is a view of the face of the beam convergence module showing details of the hexagonal pipes.

FIG. 2 is a detailed exploded view of the transducer 12 and beam convergence module 10, with FIG. 3 showing a plan view of the face of module 10. Module 10 comprises a cylindrical sheath 9, which may be formed of MYLAR® by duPont, and a plurality of pipes 15, preferably formed by a section of honeycomb material. However, other shaped pipes are equally suitable for the purpose.

The transverse dimensions of the honeycomb pipes 10 and the length of module 10 are selected in accordance with the wavelength of the radiation from transducer 12 to produce the desired convergence at the output end of the pipes 10. In the example of FIG. 1 and referring to FIG. 6, honeycomb pipes 15 are formed from 5056 aluminum having the dimensions C=0.0015", B=0.130", and A=0.110". This one-eighth inch nominal material is available from Hexcel, 11555 Dublin Blvd., Dublin, Calif. 94568. The density of the honeycomb cells determines the number of pipes in a given module cross sectional area, and thus the amount of convergence obtainable.

Although the sheath 9 of module 10 is shown in the preferred implementation as cylindrical, it is to be understood that the honeycomb element 15 and sheath 10 may have other configurations to match the particular transducer being used to drive the convergence module.

Figure 4:
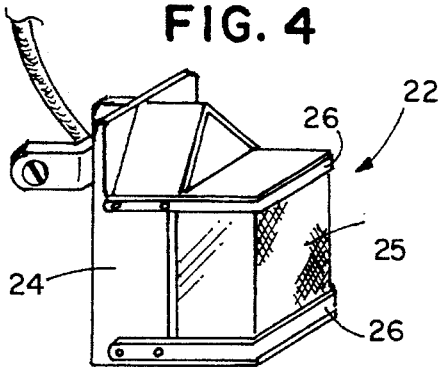
FIG. 4 is a perspective view of a typical sonar transducer element having a beam convergence module composed of a honeycomb pipe assembly attached thereto.

FIG. 4 is a perspective view of a HUMMINGBIRD® Fish Finder by Tech Sonic Industries, Inc., Eufalia, Ala. 36027, having four transducers 24, operating at 455 kHz and producing a 60 degree scan area with a 15 degree resolution beam, and having a range of about 32 feet in twenty foot depth water. As shown in FIG. 4, a rectangular bundle of pipes 25 form a convergence module in accordance with the invention, and is shown attached thereto by plastic clamps 26. Pipes 25 are formed by a section of 0.055"× 0.065" 2"×3" honeycomb material with a tube length or thickness of two inches. The 15 degree beam was reduced to 1.0 degree, and the forward range increased to 600 feet by use of the beam convergence module 25.

Figure 5:
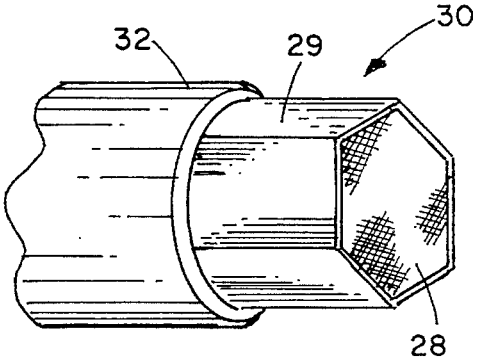
FIG. 5 is a partial perspective view of a pipe bundle formed from honeycomb material for use with a Doppler radar unit for reducing the radiated beam width of the radar antenna.
Figure 6:
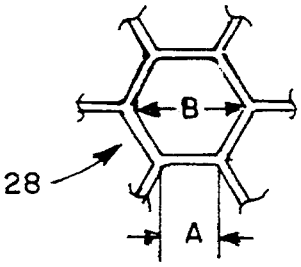
FIG. 6 is a front view of a honeycomb cell utilized in the beam convergence module.
Figure 7:
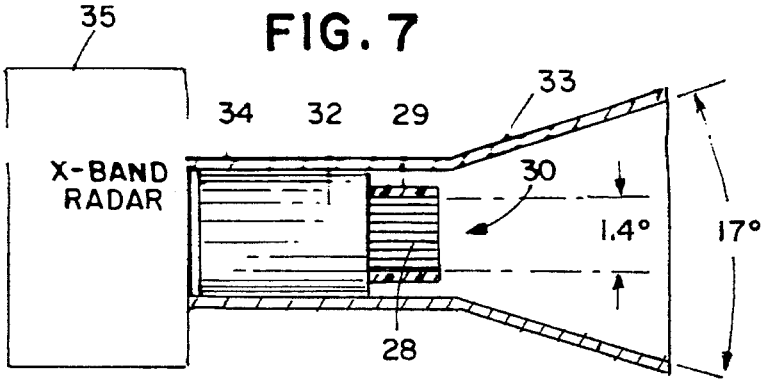
FIG. 7 a simplified diagram of a radar unit having the beam convergence device of FIG. 5 installed in the horn waveguide.

Turning to FIGS. 5, 6 and 7, the application of a beam convergence module 30 as applied to a an existing microwave radar, having a horn 33 and a circular waveguide 34, is shown. In FIG. 5, an insulating tube 32, which may be formed of polyvinylchloride, has a bundle of pipes 28 inserted therein. The bundle of pipes 28 may be insulated with a wrapping 29 of 14 mil MYLAR®, available from I. E. DuPont. Tube 32, has an outside diameter equal to the inner diameter of waveguide 34, selected to thus provide a snug fit therein. FIG. 7 illustrates the module 30 installed in the circular feed waveguide 34 to horn 33 of an X-band CW Doppler radar 35 operating in the 10 gHz band. Pipe bundle 28 of FIG. 5 is formed from Hexel 5056 honeycomb material. With reference to FIG. 6, the honeycomb material of the exemplary arrangement has dimensions A=0.055 inches and B=0.066 inches, providing about 70 pipes. In one implementation of the invention, module 30 of FIG. 7 reduced the 17 degree beam of horn 33 to about 1.4 degrees.

As will now be recognized, an efficient and effective method of extending the range, and improving the resolution of existing sonar and radar detection and distance measuring devices has been disclosed. Although specific embodiments of the invention have been disclosed for exemplary purposes, changes in the geometry, lengths, and other mechanical details may be made without departing from the scope and spirit of the invention.

I claim:

1. A sonar device for underwater use comprising:

a) a transducer for generating a sonar beam having a first beam width;

b) a beam convergence module disposed forward of said transducer and within said sonar beam;

c) a quarter-wave phasing section disposed between said transducer and said convergence module; and d) a circumferential soundproofing sheath of an acoustic attenuating material formed to surround said transducer, said phasing section, and said beam convergence module;

e) whereby said beam convergence module produces an output sonar beam having a beamwidth narrower than said first beamwidth.

2. The sonar device as defined in claim 1 in which said beam convergence module is formed from a bundle of parallel pipes disposed within an insulated sheath, each of said pipes adapted to receive a portion of radiated energy from said transducer wherein outputs from said pipes include in-phase components of said radiated energy, thereby converging said first beam to a second beamwidth narrower than said first beamwidth.

3. The sonar device as defined in claim 2 which further comprises a pod having a plastic nose piece having low attentuation to said radiated energy, a body, a tail piece, and hydrodynamic stabilizing fins, and means for supporting and connecting said pod to a watercraft.

4. The device as defined in claim 2 in which said parallel pipes each has a hexagonal cross section.

5. The device as defined in claim 4 in which said parallel pipes are formed of an electrically conductive material.

6. The device as defined in claim 5 in which said parallel pipes are formed of aluminum.

7. A method for improving the range and resolution of a sonar or device having an energy-producing transducer comprising:

a) providing a beam convergence module formed from a transverse section of a multicellular metallic honeycomb material, said material disposed within an energy-absorbing sheath;

b) disposing said module adjacent said output transducer thereby causing a beam from said transducer to converge to a preselected size at a selected distance; and c) selecting the cross sectional area and length of each cell of said module in accordance with the wavelength of said device to cause radiation from said transducer via said cells to be in phase.

8. The method as defined in claim 7 including the further step of spacing said module at a distance of an odd number of quarter wavelengths at the frequency of said transducer.

9. In a Doppler radar device having a microwave generator for producing electromagnetic energy, a waveguide connected to the generator, and an antenna connected to the waveguide, the antenna having a first beamwidth and a first range, the improvement of a beam convergence module for reducing the first beam width to a second narrower beamwidth and a second greater range, comprising:

a) a bundle of parallel conductive pipes, each of said pipes having an area to conduct said electromagnetic energy, said bundle disposed in said waveguide; and b) means for insulating said bundle from said waveguide.

10. The improvement as defined in claim 9 in which said bundle of pipes is formed from a section of metallic honeycomb material, and said insulating means is a sheath of nonconductive material having said bundle disposed therein.

11. A Doppler radar device comprising:

a) a microwave radar, said radar having a waveguide connected to a horn antenna, said antenna producing a first beamwidth;

b) an insulating tube disposed in said waveguide adjacent an output of said microwave radar; and c) a bundle of pipes installed in, and projecting from said insulating tube whereby microwave energy radiated from said pipes has a second beamwidth less than said first bandwidth.

12. The radar device as defined in claim 11 in which said bundle of pipes is formed from an electrically conductive honeycomb material.

* * * * *